US009234695B1

(12) United States Patent
Dubina et al.

(10) Patent No.: US 9,234,695 B1
(45) Date of Patent: Jan. 12, 2016

(54) LEAF SPRING FLIPPER MULLION

(71) Applicant: Electrolux Home Products, Inc., Charlotte, NC (US)

(72) Inventors: Paul Dubina, Anderson, SC (US); Adam Ellis, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/331,783

(22) Filed: Jul. 15, 2014

(51) Int. Cl.
*F25D 23/00* (2006.01)
*F25D 23/02* (2006.01)

(52) U.S. Cl.
CPC ..... *F25D 23/028* (2013.01); *F25D 23/025* (2013.01); *F25D 2323/021* (2013.01)

(58) Field of Classification Search
CPC ... F25D 23/02; F25D 25/028; F25D 2323/02; F25D 2323/021
See application file for complete search history.

(56) References Cited

U.S. PATENT DOCUMENTS 1,918,865 A * 7/1933 Purdy ..... E06B 7/18 49/313
4,120,550 A 10/1978 Sherburn
5,694,789 A 12/1997 Do
7,008,032 B2 3/2006 Chekal et al.
8,167,389 B2 * 5/2012 Han ..... F25D 23/02 16/250
2005/0046319 A1 * 3/2005 Chekal ..... F25D 11/02 312/401
2009/0113927 A1 * 5/2009 Laible ..... E05B 65/0042 62/449
2009/0273264 A1 11/2009 Butler
2009/0320509 A1 * 12/2009 Gorz ..... F25D 21/04 62/264
2012/0073321 A1 * 3/2012 Davis ..... F25D 23/028 62/449
2014/0217877 A1 * 8/2014 Miersen ..... F25D 23/028 312/405
2014/0265804 A1 * 9/2014 Wilson ..... F25D 23/02 312/405

* cited by examiner

*Primary Examiner* — Daniel Rohrhoff
(74) *Attorney, Agent, or Firm* — Pearne & Gordon LLP

(57) ABSTRACT

A refrigerator assembly includes a cabinet having one or more compartments and a door configured to provide access to the one or more compartments. The refrigerator assembly further includes a mullion portion movably attached with respect the door and a hinge assembly attaching the mullion portion to the door such that the mullion portion is rotatably movable with respect to the door about a rotational axis between a first position and a second position. The refrigerator assembly further includes a leaf spring and a cam structure. The cam structure includes a first recess for receiving the leaf spring when the mullion portion is in the first position. The cam structure further includes a second recess for receiving the leaf spring when the mullion portion is in the second position.

20 Claims, 4 Drawing Sheets

LEAF SPRING FLIPPER MULLION

BACKGROUND

1. Field

The present invention relates generally to refrigerator assemblies, and, more particularly, to a refrigerator assembly having a mullion assembly attached to a door.

2. Description of Related Art

Various types of refrigerators include side by side doors ("French Door"). Refrigerators incorporating side by side doors may use a mullion assembly to improve a seal between the doors and refrigerator cabinet. In the past, magnets, such as Neodymium magnets, have been used to pull (e.g., flip) the mullion assembly between an opened and closed position. However, magnets can be expensive and relatively difficult to incorporate. As such, it would be beneficial to reduce the use of magnets in the mullion assembly.

BRIEF SUMMARY

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a refrigerator assembly is provided comprising a cabinet comprising one or more compartments and a door configured to provide access to the one or more compartments. The refrigerator assembly further comprises a mullion portion movably attached with respect the door and a hinge assembly attaching the mullion portion to the door such that the mullion portion is rotatably movable with respect to the door about a rotational axis between a first position and a second position. The refrigerator assembly further comprises a leaf spring and a cam structure. The cam structure comprises a first recess for receiving the leaf spring when the mullion portion is in the first position. The cam structure further comprises a second recess for receiving the leaf spring when the mullion portion is in the second position.

In accordance with another aspect, a mullion assembly is provided for a refrigerator assembly comprising one or more compartments and a door configured to provide access to the one or more compartments. The mullion assembly comprises a mullion portion and a hinge assembly for movably attaching the mullion portion to the door. The hinge assembly comprises a hinge plate and is configured such that the mullion portion is rotatably movable with respect to the hinge plate about a rotational axis between a first position and a second position. The mullion assembly further comprises a leaf spring and a cam structure. The cam structure comprises a first recess for receiving the leaf spring when the mullion portion is in the first position. The cam structure further comprises a second recess for receiving the leaf spring when the mullion portion is in the second position.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION

Figure 1:
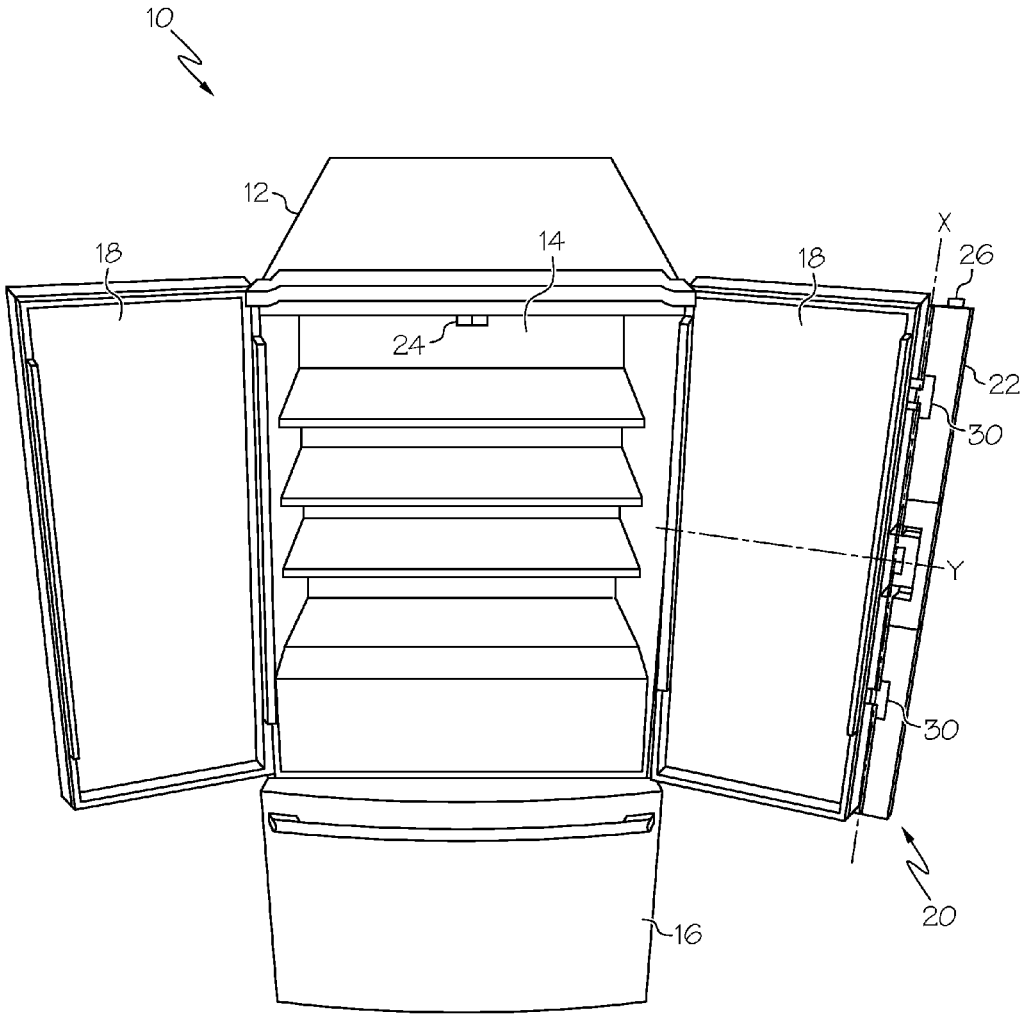
FIG. 1 is a perspective view of an example refrigerator assembly with an example mullion assembly.

Example embodiments that incorporate one or more aspects are described and illustrated in the drawings. These illustrated examples are not intended to be a limitation on the present examples. For example, one or more aspects can be utilized in other embodiments and even other types of devices. Moreover, certain terminology is used herein for convenience only and is not to be taken as a limitation on the present examples. Still further, in the drawings, the same reference numerals can be employed for designating the same elements.

Referring to the example of FIG. 1, an example of a refrigerator assembly 10 is shown. In short summary, the refrigerator assembly 10 includes a cabinet 12 having one or more compartments, such as a fresh food compartment 14 and a freezer compartment 16. The refrigerator assembly 10 further comprises one or more doors 18 configured to provide access to the one or more compartments. A mullion assembly 20 is provided in attachment with at least one of the doors 18 for improved sealing. The mullion assembly 20 includes a mullion portion 22 having an elongated mullion body that extends along substantially the entire length of the door 18. As will be described in more detail below, the mullion portion 22 is movably attached with respect to the door 18 such that the mullion portion 22 is rotatably movable with respect to the door about a rotational axis between a first (closed) and a second (open) position. The mullion assembly 20 has a cam structure that cooperates with a leaf spring to hold the mullion portion 22 in either of the first or second positions.

The refrigerator assembly 10 shown in FIG. 1 comprises one possible example of a refrigerator assembly. In this example, the refrigerator assembly 10 is a French door bottom mount freezer assembly. A French door bottom mount freezer assembly includes the fresh food compartment 14 provided at an upper portion of the refrigerator assembly 10. The freezer compartment 16 is provided at a lower portion and underneath the fresh food compartment 14. In further examples, the refrigerator assembly 10 could be provided with multiple compartments or with compartments located above and/or laterally with respect to one another. The refrigerator assembly 10 could further include a side by side fresh food compartment and freezer compartment, such that the refrigerator assembly 10 is not limited to the shown French door bottom mount freezer. In particular, the refrigerator assembly 10 could include the fresh food compartment 14 positioned laterally next to the freezer compartment 16. In yet another example, the refrigerator assembly 10 may include only a freezer compartment provided without the fresh food compartment or a fresh food compartment without the freezer compartment. Accordingly, it is to be appreciated that the refrigerator assembly 10 shown in FIG. 1 comprises only one possible example, as any number of designs and configurations are contemplated.

The refrigerator assembly 10 includes the fresh food compartment 14 maintained at a first temperature. The fresh food compartment 14 is somewhat generically depicted and defines a substantially hollow interior portion and may include shelves, drawers, or the like. The refrigerator assembly 10 can include a pair of doors 18, such as French doors, configured to provide access to the fresh food compartment 14. It is to be appreciated, however, that the refrigerator assembly 10 could include other door assemblies, and is not limited to having the French doors shown in FIG. 1. Rather, in further examples, the refrigerator assembly 10 could include a single door, or the like. The refrigerator assembly 10 can further include the freezer compartment 16 positioned adjacent and underneath the fresh food compartment 14. The freezer compartment 16 can be maintained at a second temperature that is lower than the first temperature of the fresh food compartment 14.

The refrigerator assembly 10 can further include a guide element 24. The guide element 24 is configured to engage a guide member 26 of the mullion assembly 20 during opening and closing of the door 18 that the mullion assembly 20 is attached to. The guide element 24 and guide member 26 are shown to be positioned at upper portions of the fresh food compartment 14 and the mullion assembly 20. However, in further examples, the guide element 24 and guide member 26 are not limited to these upper portions, and instead could be positioned at lower portions of the fresh food compartment 14 and the mullion assembly 20, or at both upper and lower portions. The guide element 24 and guide member 26 are illustrated schematically and may include any number of configurations. Indeed, the guide element 24 and guide member 26 could be larger or smaller than as shown.

Figure 2:
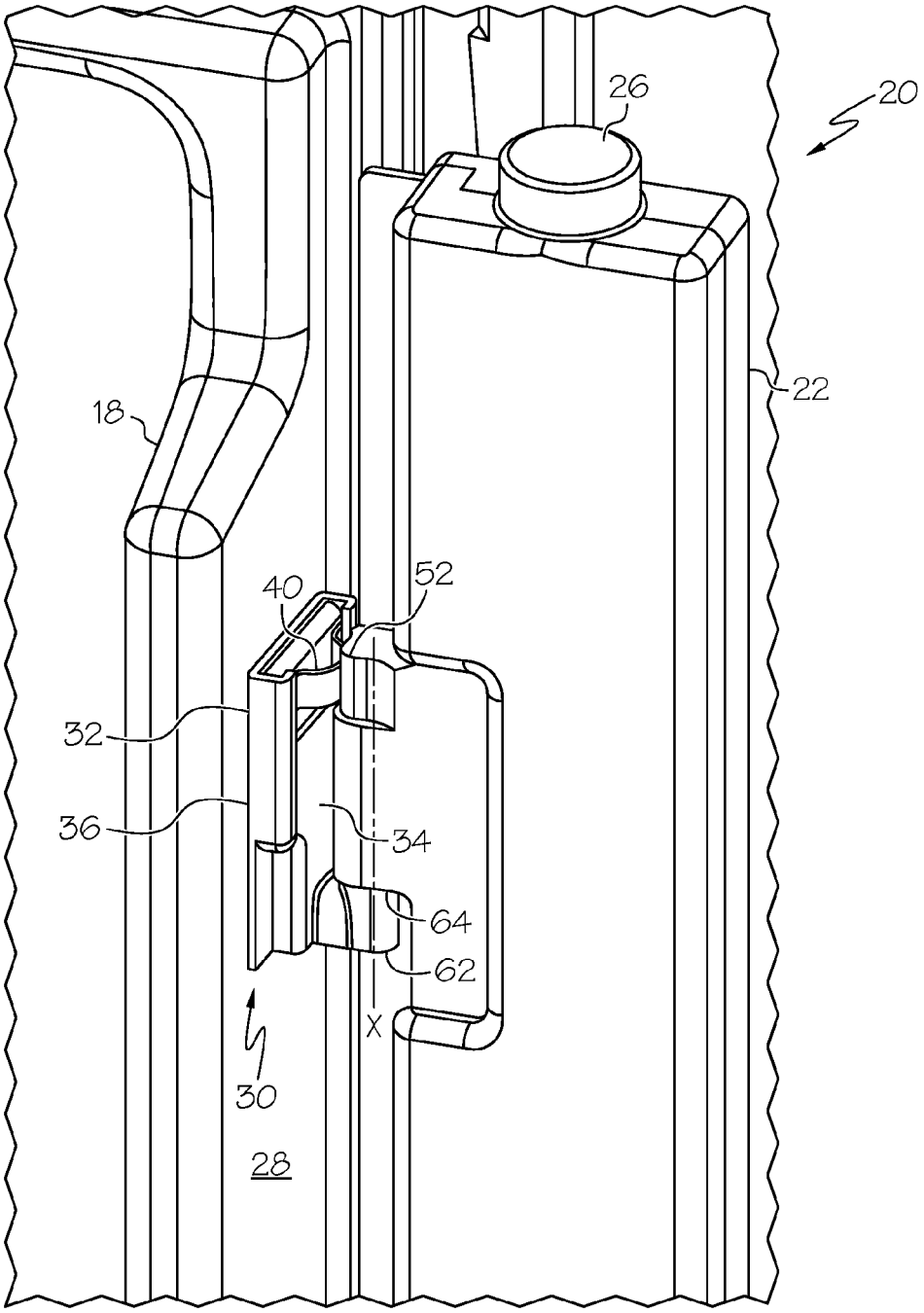
FIG. 2 is a an enlarged view of the mullion assembly attached to the door.
Figure 3:
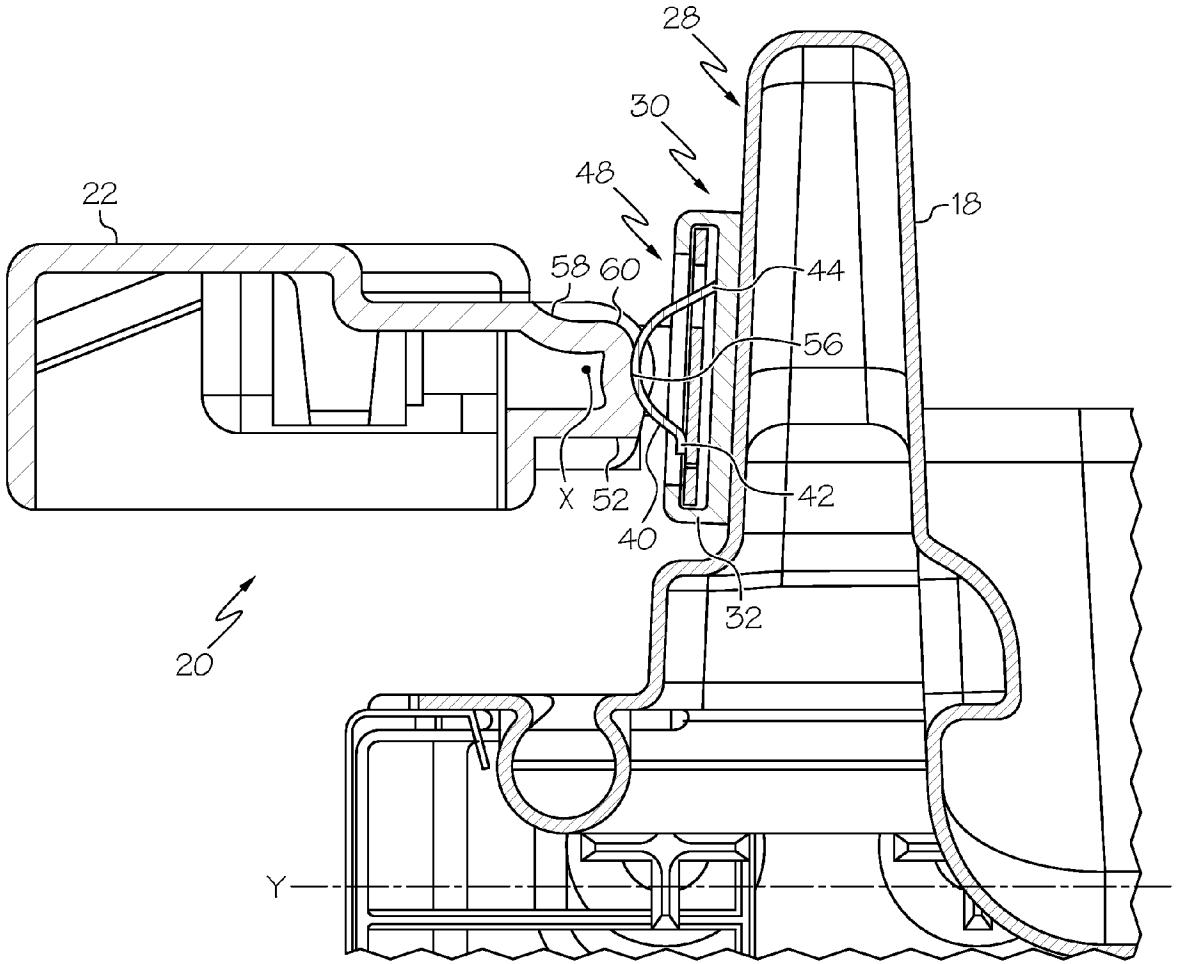
FIG. 3 is a sectional view of the mullion assembly in which a mullion portion of the mullion assembly is in a first position.
Figure 4:
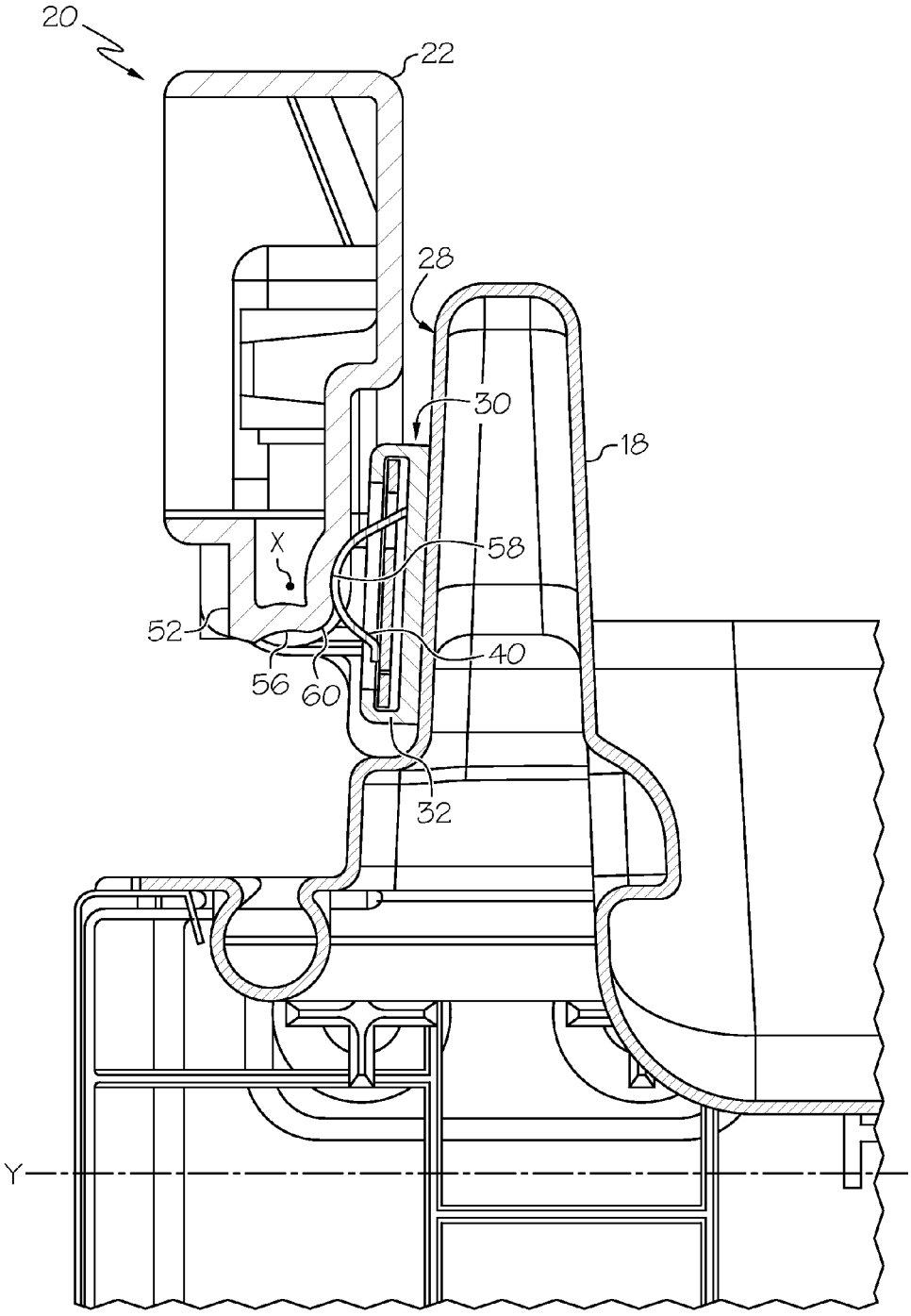
FIG. 4 is a sectional view of the mullion assembly in which a mullion portion of the mullion assembly is in a second position.

Turning now to FIGS. 2-4, the refrigerator assembly 10 includes the mullion assembly 20. The mullion assembly 20 is attached to one of the doors 18, in particular, an edge surface 28 of the door 18. The million portion 22 of the mullion assembly 20 is rotatably movable between a first (closed) position and a second (open) position about a rotational axis X. For example, when the door 18 is in a closed position, the mullion portion 22 will generally be in the first position, as shown in FIG. 3, whereupon the mullion portion 22 is arranged generally parallel to a horizontal axis Y of the door 18 (e.g., in a similar position as shown in FIG. 1). Conversely, when the door 18 is rotated to an open position, the mullion portion 22 will likewise move to the second position, as shown in FIG. 4, whereupon the mullion portion 22 extends generally perpendicular to the horizontal axis Y. It is to be appreciated that the mullion portion 22 is shown to be in the first position in FIGS. 1 and 2 for illustrative purposes and to more clearly depict portions of the mullion assembly 20 in spite of the door 18 being in the opened position. However, in operation, when the door 18 is in the opened position, the mullion portion 22 will be arranged in the second position such that the mullion portion 22 is perpendicular to the horizontal axis Y.

As shown in FIG. 1, the mullion assembly 20 can include one or more hinge assemblies 30 configured to movably attach the mullion assembly 20 to the door 18. For example, the hinge assemblies 30 can allow for pivotable movement of the mullion portion 22 with respect to the door 18. The hinge assemblies 30 can include any number of configurations. In the shown example, two hinge assemblies 30 are depicted, however in further examples, the door 18 and mullion assembly 20 could be attached via one or more hinge assemblies 30. Further, the hinge assemblies 30 are not limited to the shown position, and in further examples, could be positioned closer to a top, bottom, or center portion along a length of the door 18.

Referring to FIGS. 2-4, one of the hinge assemblies 30 will now be described in further detail. The hinge assembly 30 illustrated in FIGS. 2-4 may be used for one or more of the hinge assemblies 30 of the mullion assembly 20 though all of the hinge assemblies 30 of the mullion assembly 20 need not have the same configuration. As shown, the hinge assembly 30 can include a hinge plate 32 that is elongated, generally planar and extends along the door 18. The hinge plate 32 can have a first side 34 and an opposing second side 36. The first side 34 can be attached to the edge surface 28 of the door 18 such that the first side 34 is flush with the edge surface 28. The hinge plate 32 can be attached to the door 18 with various types of fasteners, such as mechanical fasteners (screws, nuts, bolts, etc.), adhesives (epoxy, glue, etc.) or by a snap fit structure. While the hinge plate 32 is shown to be attached at substantially upper location of the door 18 (in FIG. 2), the hinge plate 32 could be positioned higher or lower in further examples. Moreover, while the hinge plate 32 in the present example is separately attached to the edge surface 28 of the door 18, the hinge plate 32 in other examples can be integral with and defined by the edge surface 28 of the door 18.

The hinge assembly 30 can comprise a leaf spring 40 that has a substantially arcuate shape, as shown in FIGS. 3 and 4. The leaf spring 40 can have a fixed end 42 that is fixed relative to the hinge plate 32 and a free end 44 that is movable relative to the hinge plate 32, though in some examples, both ends 42, 44 may be fixed relative to the hinge plate 32. The leaf spring 40 may be integral with the hinge plate 32 or the leaf spring 40 may be a separately attached to the hinge plate 32 with one or more fasteners. The leaf spring 40 is configured such that the leaf spring 40 projects from the hinge plate 32 in a direction generally perpendicular to the edge surface 28 and toward the rotational axis X. The free end 44 of the leaf spring 40 may be provided within a recess 48 of the hinge plate 32 such that when a force is applied to the leaf spring 40 in a direction toward the edge surface 28 and away from the rotational axis X, the arcuate shape of the leaf spring 40 will flatten and the free end 44 will translate within the recess 48 in a direction away from the fixed end 42. Indeed, the hinge plate 32 is configured to retain the free end 44 within the recess 48 and guide the free end 44 away from the fixed end 42 as the leaf spring 40 is flattened.

The mullion portion 22 includes a cam structure 52 configured to cooperate with the leaf spring 40 as the mullion portion 22 is rotated between the first and second positions. The cam structure 52 defines an outwardly projecting protuberance extending from the main body of the mullion portion 22. The cam structure 52 has a generally quadrilateral shaped cross-section with rounded edges. In further examples, the cam structure 52 can include a square shaped or rectangular shaped cross-section or the like.

The cam structure 52 includes one or more stop structures for controlling movement of the mullion portion 22. The one or more stop structures can include, for example, a first recess 56 and a second recess 58. The stop structures are not so limited to including the recesses, and in further examples, the stop structures could include extensions, projections, openings, etc. The first recess 56 defines an inward recess extending towards an interior of the cam structure 52. The first recess 56 has a substantially arcuate shape, though in further examples, the first recess 56 could have linearly extending portions, or the like. Likewise, the first recess 56 could be larger (e.g., projecting deeper into the cam structure 52) or smaller (e.g., projecting shallower into the cam structure 52) than as shown.

The one or more stop structures of the cam structure 52 further includes the second recess 58. The second recess 58 is positioned approximately 90° from the first recess 56 about the rotational axis X. In further examples, however, the second recess 58 could be positioned at various other angles closer to or further from the second recess 58. The second recess 58 can have substantially the same size and shape as the first recess 56. For example, the second recess 58 defines an inward recess extending towards an interior of the cam structure 52. The second recess 58 has a substantially arcuate shape, though in further examples, the second recess 58 could have linearly extending portions, or the like. Likewise, the second recess 58 could be larger (e.g., projecting deeper into the cam structure 52) or smaller (e.g., projecting shallower into the cam structure 52) than as shown.

The one or more stop structures of the cam structure 52 further includes a stopper 60. The stopper 60 is positioned at an edge of the cam structure 52 between the first recess 56 and second recess 58. The stopper 60 defines an outwardly projecting protuberance, such that the stopper 60 projects outwardly more from the rotational axis X than both the first recess 56 and the second recess 58. The stopper 60 can be rounded (as shown) or may include linearly extending portions.

The hinge assembly 30 can further include one or more attachment structures 62. For example, the hinge assembly 30 shown in FIG. 2 comprises an attachment structure 62 positioned at a lower end of the hinge plate 32. In further examples, however, the attachment structure 62 is not limited to such a location, and could be positioned closer towards a center or upper end of the hinge plate 32. The hinge plate 32 in FIG. 2 comprises one attachment structure 62, though in further examples, any number of attachment structures are envisioned (e.g., two or more). The attachment structure 62 projects from the second side 36 in a direction away from the hinge plate 32. The attachment structure 62 can further include engagement structures, projections, or the like for movably (e.g., pivotably) attaching to another structure.

The mullion portion 22 can further include one or more attachment portions 64 for attaching to the hinge assembly 30. For example, the mullion portion 22 shown in FIG. 2 comprises an attachment portion 64 having a bore (not shown) for receiving a portion of the attachment structure 62, thus allowing the mullion portion 22 to move (e.g., pivot) with respect to the hinge assembly 30 when the portion of the attachment structure 62 is received therein. The mullion assembly 20, however, is not limited to including the attachment structures 62 and the attachment portions 64. Instead, in further examples, the mullion assembly 20 could include any number of structures that allow for pivotable movement of the mullion portion 22 relative to the hinge assembly 30 and door 18.

Referring to FIGS. 3 and 4, the operation of the mullion assembly 20 will now be described in detail. The mullion assembly 20 in FIG. 3 is depicted when the mullion portion 22 is in the first (i.e. closed) position and parallel with the horizontal axis Y. Meanwhile, the mullion assembly 20 in FIG. 4 is depicted when the mullion portion 22 is in the second (i.e. opened) position and perpendicular with the horizontal axis Y. In the first and second positions, the leaf spring 40 is respectively received within the first recess 56 and the second recess 58. The rotational axis X of the mullion portion 22 can be distanced from the hinge assembly 30 such that there is little or no interference between the leaf spring 40 and the first and second recesses 56, 58. Indeed, a shape of the leaf spring 40 in its natural state can substantially match the shapes of the first and second recesses 56, 58 such that the leaf spring 40 can be removably received within the first and second recesses 56, 58 with little or no interference therebetween.

As mentioned above, the stopper 60 projects outwardly more from the rotational axis X than the first and second recesses 56, 58. Accordingly, rotation of the mullion portion 22 between the first and second positions will cause the stopper 60 to interfere with and press against the leaf spring 40. The leaf spring 40 can flatten to accommodate for this interference with the stopper 60 and allow the mullion portion 22 to complete its rotation between the first and second positions. However, the bias of the leaf spring 40 will tend to cause the mullion portion 22 to remain in the first or second position unless sufficient rotational force is applied to the mullion portion 22 to overcome the bias of the leaf spring 40.

When the door 18 is in the closed position, the mullion portion 22 will be in the first position, as shown in FIG. 3, and the guide member 26 of the mullion portion 22 will be engaged with the guide element 24 of the refrigerator assembly 10. As the door 18 is rotated to the opened position, the guide element 24 is configured to cooperate with and guide the guide member 26 of the mullion portion 22 in a manner that causes the mullion portion 22 to rotatably move with respect to the door 18 and hinge plate 32 about the rotational axis X from the first position to the second position. As described above, the bias of the leaf spring 40 will tend to cause the mullion portion 22 to remain in the first position. However, this bias may be overcome by applying sufficient rotational force to the door 18.

When the door 18 is in the opened position, the mullion portion 22 will be in the second position, as shown in FIG. 4, and the guide member 26 of the mullion portion 22 will be disengaged with the guide element 24 of the refrigerator assembly 10. As the door 18 is rotated to the closed position, the guide member 26 of the mullion portion 22 will eventually cooperate with and engage the guide element 24 of the refrigerator assembly 10 in a manner that causes the mullion portion 22 to rotatably move with respect to the door 18 and the hinge plate 32 about the rotational axis X from the second position to the first position. As described above, the bias of the leaf spring 40 will tend to cause the mullion portion 22 to remain in the second position. However, this bias may be overcome by applying sufficient rotational force to the door 18.

By providing the leaf spring 40 and the cam structure 52 as described above, the mullion portion 22 can be held in position with respect to the hinge assembly 30 and the door 18. In particular, the bias of the leaf spring 40 can hold the mullion portion 22 such that the leaf spring 40 remains within the first recess 56 and second recess 58. The bias of the leaf spring 40 can limit the likelihood of the mullion portion 22 inadvertently moving with respect to the hinge assembly 30 and door 18. Rather, movement of the mullion portion 22 can be limited to when sufficient rotational force is applied to the door 18 to overcome the bias of the leaf spring 40.

Although the leaf spring 40 and the cooperating cam structure 52 of the mullion assembly 20 described above are oppositely provided on the hinge assembly 30 and the mullion portion 22 such that the leaf spring 40 is provided on the hinge assembly 30 and the cam structure is oppositely provided on the mullion portion 22, it is to be appreciated that the leaf spring 40 and cam structure 52 in other embodiments can be oppositely provided on the hinge assembly 30 and the mullion portion 22 such that the leaf spring 40 is provided on the mullion portion 22 and the cam structure 52 is oppositely provided on the hinge assembly 30. In such embodiments, the leaf spring 40 can similarly cooperate with the cam structure 52 as the mullion portion 22 is rotated about the rotational axis to bias the mullion portion 22 toward the first and second positions.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigerator assembly comprising:

a cabinet comprising one or more compartments;

a door configured to provide access to the one or more compartments;

a mullion portion movably attached with respect the door;

a hinge assembly attaching the mullion portion to the door such that the mullion portion is rotatably movable with respect to the door about a rotational axis between a first position and a second position; and a leaf spring and a cam structure oppositely provided on the hinge assembly and the mullion portion, the cam structure comprising a first recess for receiving the leaf spring when the mullion portion is in the first position, the cam structure further comprising a second recess for receiving the leaf spring when the mullion portion is in the second position.

2. The refrigerator assembly of claim 1, wherein the hinge assembly comprises the leaf spring and the mullion portion comprises the cam structure.

3. The refrigerator assembly of claim 1, wherein the second recess is positioned approximately 90° from the first recess about the rotational axis, and the cam structure comprises a stopper that is positioned between the first recess and second recess.

4. The refrigerator assembly of claim 3, wherein the stopper projects outwardly more from the rotational axis than both the first recess and the second recess.

5. The refrigerator assembly of claim 3, wherein rotation of the mullion portion between the first position and the second position causes the stopper to press against the leaf spring.

6. The refrigerator assembly of claim 1, wherein a shape of the leaf spring substantially matches a shape of the first recess and the second recess such that the leaf spring can be removably received within the first recess and the second recess.

7. The refrigerator assembly of claim 1, wherein the leaf spring, the first recess, and the second recess each comprise a substantially arcuate shape.

8. The refrigerator assembly of claim 1, wherein the leaf spring comprises a free end and a fixed end, wherein the fixed end is fixed relative to a hinge plate of the hinge assembly and the free end is movable relative to the hinge plate.

9. The refrigerator assembly of claim 8, wherein the free end is provided within a recess of the hinge plate.

10. The refrigerator assembly of claim 1, wherein the leaf spring projects from a hinge plate of the hinge assembly in a direction toward the rotational axis.

11. A mullion assembly for a refrigerator assembly comprising one or more compartments and a door configured to provide access to the one or more compartments, the mullion assembly comprising:

a mullion portion;

a hinge assembly for movably attaching the mullion portion to the door, wherein the hinge assembly comprises a hinge plate and is configured such that the mullion portion is rotatably movable with respect to the hinge plate about a rotational axis between a first position and a second position; and a leaf spring and a cam structure oppositely provided on the hinge assembly and the mullion portion, the cam structure comprising a first recess for receiving the leaf spring when the mullion portion is in the first position, the cam structure further comprising a second recess for receiving the leaf spring when the mullion portion is in the second position.

12. The mullion assembly of claim 11, wherein the hinge assembly comprises the leaf spring and the mullion portion comprises the cam structure.

13. The mullion assembly of claim 11, wherein the second recess is positioned approximately 90° from the first recess about the rotational axis, and the cam structure comprises a stopper that is positioned between the first recess and second recess.

14. The mullion assembly of claim 13, wherein the stopper projects outwardly more from the rotational axis than both the first recess and the second recess.

15. The mullion assembly of claim 13, wherein rotation of the mullion portion between the first position and the second position causes the stopper to press against the leaf spring.

16. The mullion assembly of claim 11, wherein a shape of the leaf spring substantially matches a shape of the first recess and the second recess such that the leaf spring can be removably received within the first recess and the second recess.

17. The mullion assembly of claim 11, wherein the leaf spring, the first recess, and the second recess each comprise a substantially arcuate shape.

18. The mullion assembly of claim 11, wherein the leaf spring comprises a free end and a fixed end, wherein the fixed end is fixed relative to a hinge plate of the hinge assembly and the free end is movable relative to the hinge plate.

19. The mullion assembly of claim 18, wherein the free end is provided within a recess of the hinge plate.

20. The mullion assembly of claim 11, wherein the leaf spring projects from a hinge plate of the hinge assembly in a direction toward the rotational axis.

* * * * *